US005160234A

United States Patent [19]

Lazar

[11] Patent Number: 5,160,234

[45] Date of Patent: Nov. 3, 1992

[54] BINDING APPARATUS

[76] Inventor: Peter Lazar, Tannenstr. 11, D-4040 Neuss 21, Fed. Rep. of Germany

[21] Appl. No.: 517,715

[22] Filed: May 2, 1990

[30] Foreign Application Priority Data

May 3, 1989 [DE] Fed. Rep. of Germany ..... 3914571

[51] Int. Cl.[5] ..... B42B 9/00

[52] U.S. Cl. ..... 412/20; 156/311; 156/381; 156/498; 156/908; 412/900; 412/902

[58] Field of Search ..... 281/21.1; 412/8, 4, 412/20, 900, 902; 156/311, 498, 908, 499, 497, 381, 583.1; 165/61; 219/243, 521

[56] References Cited

U.S. PATENT DOCUMENTS

| | | | |
|---|---|---|---|
| 3,715,260 | 11/1973 | Dornemann et al. | 156/459 |
| 3,717,366 | 5/1973 | Decker | 281/21 R |
| 3,788,921 | 1/1974 | Polit et al. | 156/216 |
| 3,911,517 | 10/1975 | Davis | 156/908 X |
| 3,956,057 | 5/1976 | Jung | 156/578 |
| 4,009,498 | 3/1977 | Staats et al. | 156/583.1 |
| 4,141,100 | 2/1979 | Domroe et al. | 156/908 X |
| 4,149,289 | 4/1979 | Sahlin | 156/908 X |
| 4,150,453 | 4/1979 | Vaughn | 156/311 |
| 4,281,785 | 8/1981 | Brooks | 156/311 X |
| 4,526,642 | 7/1985 | Caughey | 156/311 X |
| 4,863,332 | 4/1989 | Wiholm et al. | 412/37 |

FOREIGN PATENT DOCUMENTS

| | | |
|---|---|---|
| 2331612 | 3/1974 | Fed. Rep. of Germany . |
| 3514201 | 7/1986 | Fed. Rep. of Germany . |

*Primary Examiner*—John J. Gallagher
*Assistant Examiner*—Michele K. Yoder
*Attorney, Agent, or Firm*—Joseph W. Berenato, III

[57] ABSTRACT

A sheet binder includes a frame having first and second spaced parallel support walls for receiving therebetween a plurality of sheet to be bound. The walls each have a first end for defining therebetween an opening into which the sheets are inserted, and a second end defining therebetween a binding zone. A heating plate and deposition base are operably associated with the second ends for applying an adhesive strip to associated edges of the sheets for binding the sheets together. The plate and base are displaceably supported within the frame for being linearly and alternatingly moved into and out of the binding zone.

36 Claims, 1 Drawing Sheet

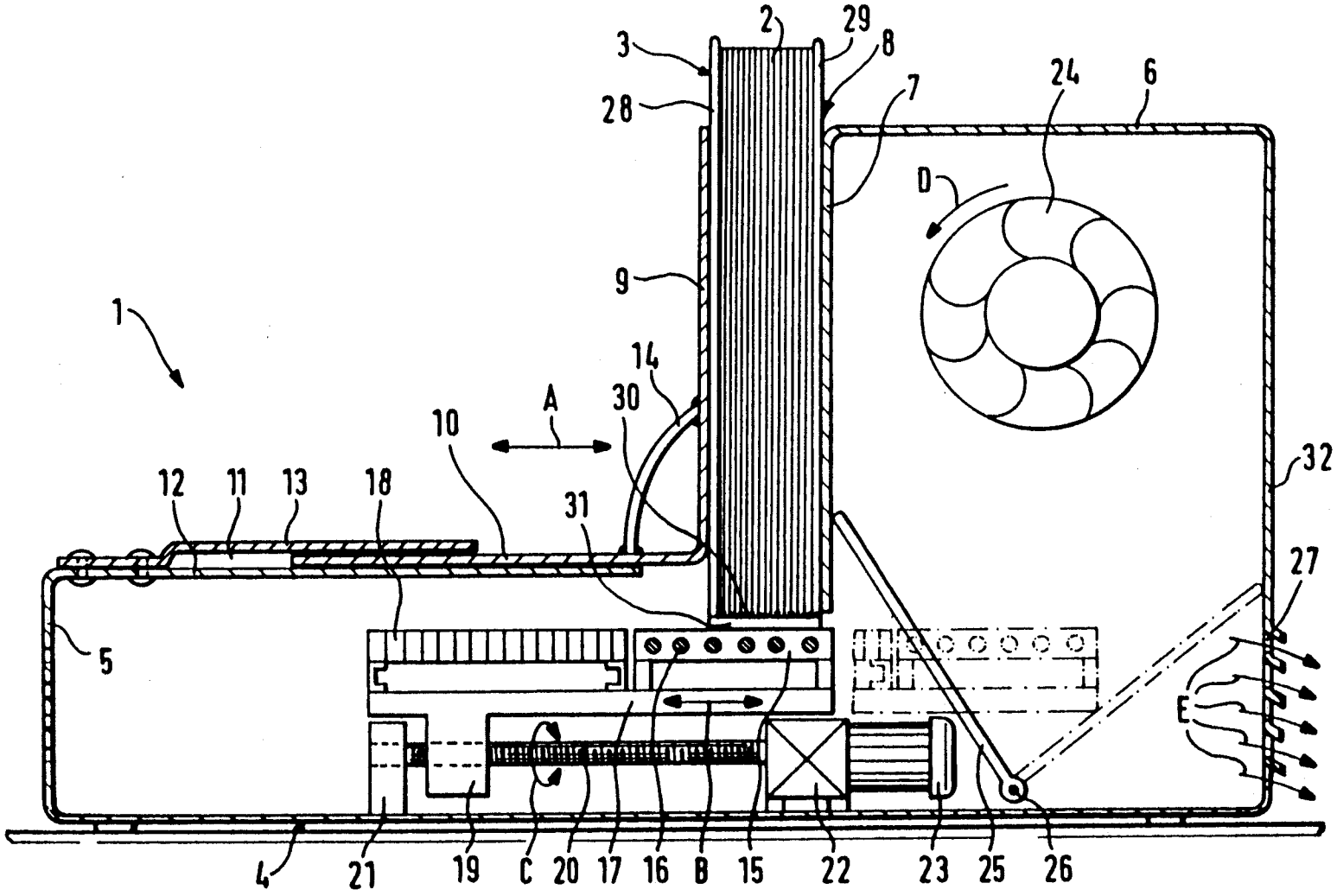
32
27
E
6
24
D
7
8
29
2
3
28
9
14
30
31
A
10
18
13
11
12
1
5
4
21
19
C
20
17
16
B
15
22
23
25
26

BINDING APPARATUS

BACKGROUND OF THE INVENTION

The invention concerns apparatus for binding loose sheets into binding covers provided at their backs with a thermoplastic adhesive, said apparatus comprising a frame and two parallel support walls that together form an input shaft to adjust the binding covers filled with the sheets, said shaft being defined at the bottom and during binding by a heating plate, and further comprising a deposition base to remove the finished, bound folder unit consisting of binding covers and sheets.

Such binding apparatus illustratively is described in the German patent 35 14 222. It comprises a frame with an input shaft formed by two parallel Vertical support walls. One support wall is stationary in the frame, the other is displaceably supported, namely being movable toward and away from the stationary one. In this manner the spacing between the two support walls can be mutually adjusted to maintain their parallel position.

The input shaft is defined underneath the adjustment zone of the displaceable support wall by a heating plate. This heating plate consists of an upper-side deposition base and an electric heater allowing to raise the deposition base to about 200° C. The heating plate is stationary.

In order to make a book or a notebook, first a stack of papers or also of plastic foils is formed which then is inserted into a binding cover. Such binding covers consist of a back with a joint to integrate the binding sides and further of a strip of hot-melt adhesive deposited on the inside of the back. When binding, the whole binding cover with the inserted sheet is introduced into the input shaft in such manner that the outside of the back comes to rest on the heating plate. Then the displaceable support wall is moved toward the stationary support wall in order that the whole binding cover retain its vertical position during binding. Next the heater plate is heated electrically to a temperature higher than the melting point of the hot-melt strip. This strip then softens and accordingly the sheets inserted into the whole binding cover sink by their lower edges into the strip of hot-melt adhesive and are wetted in the process. After a specified time the bound unit consisting of binding cover and sheets is removed from the binding apparatus and for that purpose the displaceable support wall is retracted. Thereupon the bound unit is either placed with the back facing down on a separate cooling stand or else, for instance in the case of the binding apparatus of the German patent 35 14 222 it is deposited—again with the back down—on a deposition base integrated into the binding apparatus where this bound unit can cool. The strip of hot melt solidifies again and hard binding of the sheets into the whole binding cover has thus been achieved.

The known binding apparatus suffer from the operational drawback that following binding, the bound units must be removed from the apparatus and be carried to a special deposition base. It is the object of the invention therefore to create a binding apparatus permitting easy cooling of the finished bound unit consisting of the binding cover and sheets.

This problem is solved by the invention for binding apparatus of the above species in that the heating plate and the deposition base are supported in movable manner in the frame in such a way that they can be alternatingly displaced into or out of the zone of the input shaft.

SUMMARY OF THE INVENTION

Accordingly the basic concept of the invention calls for the heating plate now to be displaceable and furthermore now to form a pair with the deposition base for the finished bound units, where this pair can be moved alternatingly into the zone of the input shaft. Therefore, following heating, the heating plate may be moved out of the input-shaft zone and instead the deposition base may be moved into it, whereby the bound unit is supported by the cool deposition base and thereby shall cool rapidly. Hence there is no longer the requirement to lift the bound unit out of the input shaft to achieve cooling. The bound unit can remain therein without as a result extending the cooling time. It will be removed only after cooling, at which time there is already a solid bond between the sheets and the binding cover, so that the bound unit is ready for use at once. That was not the case for the previously known solutions, wherein it might happen that during the movement from the input shaft to the deposition base, the sheets would shift inside the binding cover with attendant effects on the bond between binding cover and sheets.

In the implementation of the invention, the heating plate and the deposition base are guided in such manner that a binding cover present in the input shaft shall also be supported when switching from heating plate to deposition base.

It was found appropriate to guide the heating plate and the deposition base transversely to their longitudinal axes and to arrange them adjacent to one another, with heating plate and deposition base being supported in horizontally displaceable manner. Especially advantageously the heating plate and the deposition base shall be mounted together on a carriage, with the deposition base possibly being somewhat lower than the heater plate so that no impediments shall be encountered when switching from the heating plate to the deposition base.

Basically the switching motion of heating plate and deposition base can be carried out manually, for instance using a slider projecting from a frame or using a hand crank through a gearing mechanism. However, a binding apparatus anyway being powered electrically, at least one electric motor suggests itself to drive the heating plate and the deposition base into switching motions. In a simple embodiment mode, the electric motor(s) may be actuated by an electric switch accessible from the outside. Yet operation of the binding apparatus shall be even more convenient if a control regulating the energy to the heating plate and the electric motor(s) is provided to automatically turn on the electric motor(s) moving the heating plate out of, and the deposition plate into the zone of the input shaft after the power supply to the heating plate has been turned off or down. In many cases a control for the electric energy to the heating plate already is present (German patent 35 14 201). By a slight addition of switching means, this control can be so modified to also drive the motions of the heating plate and deposition base. In that case binding and cooling shall be fully automatic.

The control system may be perfected furthermore by being provided with a sensor detecting a binding cover in the input shaft, the control system actuating the electric motor(s) to drive the deposition base out of, and the heating plate into the zone of the input shaft when the sensor transmits an empty input shaft. By means of this control system the binding apparatus shall be returned—following cooling of the bound unit and its removal from the binding apparatus—into its initial state with the heating plate underneath the adjustment shaft, so that another binding procedure may start. Because this follows from the control system, again no operation is required. Alternatively, the control system may turn on the electric motor(s) to move the deposition base out of, and the heating plate into the input shaft when the power to the heating plate is turned ON or to full rated power.

Especially advantageously the design of the invention of heating plate and deposition base shall be supplemented with an electrically powered blower with an air duct to the lower region of the input shaft. Thereby the cooling of the bound unit shall be substantially accelerated and the input shaft can be cleared rapidly for new binding steps. In this respect radial cylinder blowers are recommended, which are very quiet and may be made to match the length of the heating plate with their axis of rotation parallel to the longitudinal axis of the heating plate. However axial blowers are equally applicable.

In another embodiment of the invention, at least one air flow baffle is provided which can be moved from a position in which the airflow is deflected from the input shaft to a position in which it is directed toward it. In this manner the heating plate shall not be exposed during heating, that is during binding, to the cooling air flow, in other words the air flow shall not degrade the effect of the heating plate. The air flow baffle(s) may be kinematically coupled to the heating plate and/or the deposition base that the air flow baffle(s) shall assume a position deflecting the air flow away from the input shaft when the heating plate is in the vicinity of the input shaft, and shall assume a position directing the air flow into the zone of the input shaft when the deposition base is in said zone. Accordingly the air flow baffle(s) so change(s) its (their) position(s) because of the motion of the heating plate or deposition base that the air flow only then will be made to pass into the zone of the input shaft when the deposition base shall be present in said zone. Where however a control system is provided to regulate the power to the heating plate it should include additional switching gear to control the blower in such a way that the blower will be turned on when the heating plate is turned off or turned down and/or when the heating plate is moved out of the input shaft, and so that the blower will be turned off when the heating plate is being moved out, or is out of the zone of the input shaft. Such circuitry is especially recommended because the blower power is called on only for cooling and because noise is restricted to that step.

Lastly, if so desired, the invention provides for a cover plate to cover the heating plate when in the position outside the input shaft zone to protect against the air flow to prevent cooling from it and so that the residual heat may be used for the next binding procedure.

BRIEF DESCRIPTION OF THE DRAWING

The invention is elucidated in the drawing by means of an illustrative embodiment. The drawing shows a vertical longitudinal section of a binding apparatus 1 for binding in particular paper sheets 2 into a binding cover 3.

DESCRIPTION OF THE PREFERRED EMBODIMENT

The binding apparatus 1 comprises a frame 4 in the form of a boxy housing. It may consist of steel sheet-metal or plastic. In this view, it includes a left, flat segment 5 and a high segment 6 on the right. The high segment 6 includes a vertical support wall 7 limiting an input shaft 8. This input shaft 8 is limited on the other side by a further support wall 9 also forming a vertical surface and integrated into a slide component 10. The slide component 10 is seated in a horizontal guide slit 11 formed at the lower side by the ceiling 12 of the flat segment 5 of frame 4 and at the upper side by a guide wall 13 riveted onto the ceiling 12. A handle 14 stabilizes the slide component 10 and the support wall 9 and serves to slide in the directions of the double arrow A.

The input shaft 8 is limited at the bottom by a heater plate 15 acting through heater rods illustratively denoted by 16. The heater rods 16 are connected to an electric power supply. The heating plate 15 rests on a carriage 17 displaceably supported in horizontal manner in the directions of the double arrow B and thereby transversely to the longitudinal direction of the heating plate 15. The support has been omitted from the drawing for the sake of clarity. It may be a conventional roller support.

A deposition plate 18 is mounted on the left next to the heating plate 15 and also rests on the carriage 17. Its length (perpendicularly to the plane of the drawing) is about the same as that of the heating plate 15 and it is at about the same level. It can also be mounted somewhat lower.

The carriage 17 is provided at its base with an extension 19 itself comprising a borehole with a spindle nut. A spindle 20 passes through the spindle nut and rests on the left side in a bearing 21 and on the right side in a gear unit 22 to which is mounted an electric motor 23. The electric motor 23 is reversible, that is the spindle 20 can be rotated in both directions (double arrow C). Depending on the rotation of the spindle 20, the carriage 17 and thereby the heating plate 15 and the deposition plate 18 shall be moved horizontally in the directions of the double arrow B.

A cylinder blower 24 moving in the counter-clockwise direction, i.e. in that of the arrow D, is present in the upper part of the high segment 6. This blower is driven by an electric motor. The lower part of the high segment 6 of the frame 4 supports an air flow baffle 25 which pivots about the axis 26. Said baffle is in the position shown by solid lines during binding, namely resting against the back side of the stationary support wall 7. As a result the air flow is deflected from the input shaft 8 and made to pass through discharge louvers 27 out of the frame 4 (arrows E).

The above described binding apparatus operates as follows:

To prepare for binding, a stack of paper sheets 2 is inserted into the binding cover 3 between the binding sides 28, 29 in such a manner that the lower-end edges press against a hot-melt adhesive 30 deposited on, and affixed to the inside of the binding back of the binding cover 3. The strip of hot-melt adhesive 3 at this time is still hard because being at ambient temperature.

The unit consisting of the binding cover 3 and the paper sheets 2 is next inserted—as represented—into the input shaft 8, that is, standing and with the binding back 31 downward. For that purpose the displaceable support wall 9 is moved away from the stationary support wall 7 so that enough space be available for insertion. The binding back 31 thereby comes to rest by its outside against the heating plate 15. Next the movable support wall 9 is returned toward the stationary support wall 7 until the binding unit consisting of binding cover 3 and paper sheets 2 is clamped between the two support walls 7, 9.

Then electric power is applied to the heating plate 15. This may be carried out manually using a turn-on switch, but also automatically using a sensor, for instance a light barrier detecting the inserted bound unit. As a result the heating plate is raised to a temperature at which the hot-melt adhesive strip 30 softens and therefore the lower-end edges of the paper sheets 2 sink into the hot-melt adhesive strip 30 and are wetted by it. The duration of the power applied to the heating plate 15 may be controlled manually or by means of a regulator such as described in the German patent 35 14 201.

Following a time interval sufficient to soften the hot-melt adhesive strip 30, the electric motor 23 is turned on in such a direction that the carriage 17 and hence the heating plate 15 and the deposition plate 18 are moved to the right in this Figure. The electric motor 23 may be turned on manually, for instance when the binding apparatus 1 transmits a suitable signal upon termination of heating, or it may take place automatically by the time-control lowering the power to the heating plate 15 at the end of the heating phase or even turning it off. In this manner the heating plate 15 arrives in the zone of the high segment 6 of the frame 4 until it assumes the position shown in dash-dot lines. In this process it, i.e. the carriage 17 impacts and forces the air baffle 25 into the same direction, whereby it shall come to rest against the back wall 32 of the high segment 6. The air flow issuing from the cylinder blower 24 therefore cannot find its wa to the discharge louver 27, in other words the air flow is now constrained to move toward the flat segment 5 of the frame 4.

Because of the displacement of the carriage 17, the deposition plate 18 arrives in the zone of the input shaft 8 of which it then forms the lower boundary. Thereby the binding back 31 slips from the heating plate 15 onto the deposition plate 18. Appropriate insulating steps assure that the deposition plate 18 shall not be heated by the energizing of the heating plate 15, i.e., it will form thereupon a cool surface for the heated binding back 31. For that purpose the deposition plate 18 also may be designed as a perforated plate or the like. Contact with the deposition plate 18 entails rapid cooling of the binding back 31 and hence to solidification of the hot-melt strip 30. This is enhanced by the cool air flow generated by the cylinder blower 24 and deflected by the air baffle 25 toward the input shaft 8.

Upon solidification of the hot-melt strip 30, the paper sheets 2 have been firmly affixed to the binding cover 3. At the end of the cooling, the bound unit of binding cover 3 and paper sheets 2 is ready for immediate handling without thereby affecting the bond between the binding cover 3 and the hot-melt adhesive strip 30.

The carriage 17 may be manually reset into the position shown in solid lines by actuating a suitable switch, but also by means of a corresponding control system. In the former case the termination of cooling may be displayed by a suitable signal which will be ON after a specific time. In the latter case, a number of controls are possible. Illustratively the return of the carriage 17 may be controlled by a sensor which upon the removal of the bound unit detects the empty input shaft 8 and thereby turns on the electric motor 23 in a direction of rotation that displaces the carriage 17 to the left until it assumes again the initial position with the heating plate 15 in the zone of the input shaft 8. However the control also may be such that said motion shall be initiated only after a new binding cover 3 has been inserted and the heating plate 15 has been energized.

Jointly with the return of the carriage 17, the baffle 25 moves back into the position wherein it rests against the back side of the stationary support wall 7. This motion illustratively can be implemented by a spring but also by kinematics to the carriage 17. In addition or alternatively to the movable air baffle 25, the cylinder blower 24 also may be included into the automatic control in such a way that it shall be only actuated and shall only be operational as soon and as long as the carriage 17 moves to the right and the deposition plate 18 is underneath the input shaft 8. Where appropriate, the heating plate 15 may be moved underneath a covering protecting it from the air flow of the cylinder blower 24.

I claim:

1. A sheet binder, comprising:

a) a frame;

b) first and second spaced parallel support walls operably associated with said frame for receiving therebetween a plurality of sheets to be bound, said walls each have a first end for defining therebetween an opening into which the sheets are inserted and a second end defining therebetween a binding zone; and c) a heating plate and a deposition base operably associated with said second ends for applying an adhesive strip to associated edges of the sheets for binding the sheets together, said plate and base being displaceably supported within said frame for being moved linearly and alternatingly into and out of said binding zone.

2. The binder of claim 1, wherein:

a) said plate and base are adjacently disposed.

3. The binder of claim 1, wherein:

a) said walls extend vertically, and said plate and base move horizontally.

4. The binder of claim 1, wherein:

a) a movable carriage is positioned within said frame, and said plate and base are mounted to said carriage.

5. The binder of claim 1, wherein:

a) said plate is disposed on a first plane, and said base is disposed on a second plane spaced from said second ends a distance exceeding the distance said first plane is spaced from said second ends.

6. The binder of claim 3, wherein:

a) said second ends are disposed below said first ends; and b) said plate is disposed on a first plane and said base is disposed on a second plane which is lower than said first plane.

7. The binder of claim 1, wherein:

a) an electric motor is operably associated with said plate and base for causing movement thereof.

8. The binder of claim 7, further comprising:

a) a control system operably associated with said electric motor and said heating plate for operating said motor and plate.

9. The binder of claim 8, wherein:

a) a sensor is operably associated with said support walls and said control system for causing said heating plate to be moved into said binding zone when no sheets are detected between said walls.

10. The binder of claim 8, wherein:

a) said control system includes means for operating said motor so that said heating plate is moved into said binding zone when binding is desired.

11. The binder of claim 1, further comprising:

a) an electrically driven blower operably associated with said frame for causing air to flow into said binding zone.

12. The binder of claim 11, wherein:

a) said blower is a radial cylinder blower.

13. The binder of claim 12, wherein:

a) said blower has a length substantially equal to the length of said plate, and has an axis of rotation parallel to the longitudinal axis of said plate.

14. The binder of claim 11, wherein:

a) a baffle is pivotally mounted within said frame for causing air to be selectively directed toward and away from said binding zone.

15. The binder of claim 14, wherein:

a) means kinematically link one of said plate and base to said baffle for causing air to be directed to said binding zone when said base is in said binding zone and for causing air to be directed away from said binding zone when said plate is in said binding zone.

16. The binder of claim 11, further comprising:

a) a control means operably associated with said plate and said blower for causing operation of said blower when said plate is not in said binding zone and for preventing operation of said blower when said plate is in said binding zone.

17. The binder of claim 11, wherein:

a) a plate covers said heating plate when said heating plate is in said binding zone.

18. The binder of claim 11, wherein:

a) said walls are vertically disposed and said second ends are disposed below said first ends; and b) said blower is disposed above said plate and base and rotates on an axis parallel to said opening.

19. A binding apparatus, comprising:

a) first and second oppositely facing support walls for defining therebetween an opening for receiving binding covers and a plurality of sheets to be bound thereto, said support walls having aligned lower edges;

b) a heating plate and a deposition base disposed below said lower edges, said plate and base lying substantially on a common plane; and c) means operably associated with said base and plate for causing cooperating alternating movement thereof along said plane into operative association with said lower edges.

20. The apparatus of claim 19, wherein:

a) said plate and base are adjacently disposed, and are moveable generally transverse to said walls.

21. The apparatus of claim 19, wherein:

a) said walls extend vertically and said plate and base move horizontally.

22. The apparatus of claim 19, wherein:

a) a carriage is displaceably mounted within said frame, and said plate and base are mounted to said carriage.

23. The apparatus of claim 21, wherein:

a) said base is offset below said plate an amount sufficient so that no impediments are encountered when switching from said plate to said base.

24. The apparatus of claim 19, wherein:

a) an electric motor is operably associated with said plate and base for causing movement thereof.

25. The apparatus of claim 24, wherein:

a) means are operably associated with said plate and said motor for causing movement of said plate out of said binding zone when the adhesive strip has been applied to the sheets.

26. The apparatus of claim 25, wherein:

a) a sensor is operably associated with said causing means and with said binding zone for causing said plate to be moved into said binding zone when no sheets are positioned therein.

27. The apparatus of claim 25, wherein:

a) said causing means is operable to move said plate into said binding zone when binding is desired.

28. The apparatus of claim 19, further comprising:

a) an electrically driven blower operably associated with said plate and base for supplying air to said binding zone.

29. The apparatus of claim 28, wherein:

a) said blower is a radial cylinder blower and rotates on an axis parallel to said walls.

30. The apparatus of claim 28, wherein:

a) a pivotal baffle is operably associated with said plate and base for directing air toward said binding zone when said base is in said binding zone and for diverting air therefrom when said plate is in said binding zone.

31. The apparatus of claim 30, wherein:

a) means operably connect one of said plate and said base with said baffle for causing pivoting thereof.

32. The apparatus of claim 28, wherein:

a) means are operably associated with said blower and said plate for causing operation of said blower when said plate is not in said binding zone and for preventing operation of said blower when said plate is in said binding zone.

33. The apparatus of claim 28, wherein:

a) means cover said plate when said plate is not in said binding zone.

34. The apparatus of claim 22, wherein said causing means includes:

a) a rotatable spindle engaged with said carriage and a drive means operably associated with said spindle for causing selective operation thereof so that rotation of said spindle by said drive means causes cooperating movement of said carriage.

35. The apparatus of claim 34, wherein:

a) said spindle extends generally transverse to said walls.

36. The apparatus of claim 19, wherein:

a) said plate and base extend parallel to said walls and have a length substantially equal thereto.

* * * * *